US007318569B1

(12) United States Patent
Bilotta

(10) Patent No.: US 7,318,569 B1
(45) Date of Patent: Jan. 15, 2008

(54) COLLAPSIBLE BAG HOLDER

(76) Inventor: Michael F Bilotta, 1500 Santa Margarita Dr., Fallbrook, CA (US) 92028-1637

( * ) Notice: Subject to any disclaimer, the term of this patent is extended or adjusted under 35 U.S.C. 154(b) by 320 days.

(21) Appl. No.: 11/103,697

(22) Filed: Apr. 11, 2005

Related U.S. Application Data

(60) Provisional application No. 60/561,411, filed on Apr. 12, 2004.

(51) Int. Cl.
*A63B 55/04* (2006.01)

(52) U.S. Cl. ..... 248/97; 248/99; 248/164; D34/5

(58) Field of Classification Search ..... 248/97, 248/99, 95, 153, 164, 166, 175, 440; D34/5, D34/6; 16/221, 374, 377, 363
See application file for complete search history.

(56) References Cited

U.S. PATENT DOCUMENTS

| | | | | |
|---|---|---|---|---|
| 1,491,801 | A * | 4/1924 | Holbrook | 248/164 |
| 2,666,681 | A * | 1/1954 | Adler | 108/12 |
| 2,845,317 | A * | 7/1958 | Orman | 248/164 |
| 3,240,457 | A * | 3/1966 | Backlund et al. | 248/99 |
| 4,467,989 | A * | 8/1984 | Stroh | 248/97 |
| 4,723,741 | A * | 2/1988 | Doering | 248/97 |
| 4,860,982 | A * | 8/1989 | Berlant | 248/100 |
| 4,892,277 | A * | 1/1990 | Tobis | 248/101 |
| 4,953,815 | A * | 9/1990 | Beymer et al. | 248/97 |
| 6,419,193 | B1 * | 7/2002 | Rodriquez | 248/98 |
| 6,722,618 | B1 * | 4/2004 | Wu | 248/166 |
| 7,032,868 | B2 * | 4/2006 | Mutert | 248/99 |

* cited by examiner

*Primary Examiner*—Anita M. King
(74) *Attorney, Agent, or Firm*—Michael Bilotta

(57) ABSTRACT

A collapsible device for holding a bag with integrated handles open for the purpose of filling the bag.

14 Claims, 14 Drawing Sheets

COLLAPSIBLE BAG HOLDER

RELATED APPLICATION

This U.S. patent application claims priority to U.S. Provisional Patent Application Ser. No. 60/561,411, filed Apr. 12, 2004.

BRIEF SUMMARY

A collapsible frame formed to hold a bag with integrally formed handles open for filling the bag.

DETAILED DESCRIPTION OF THE EMBODIMENTS

Figure 1:
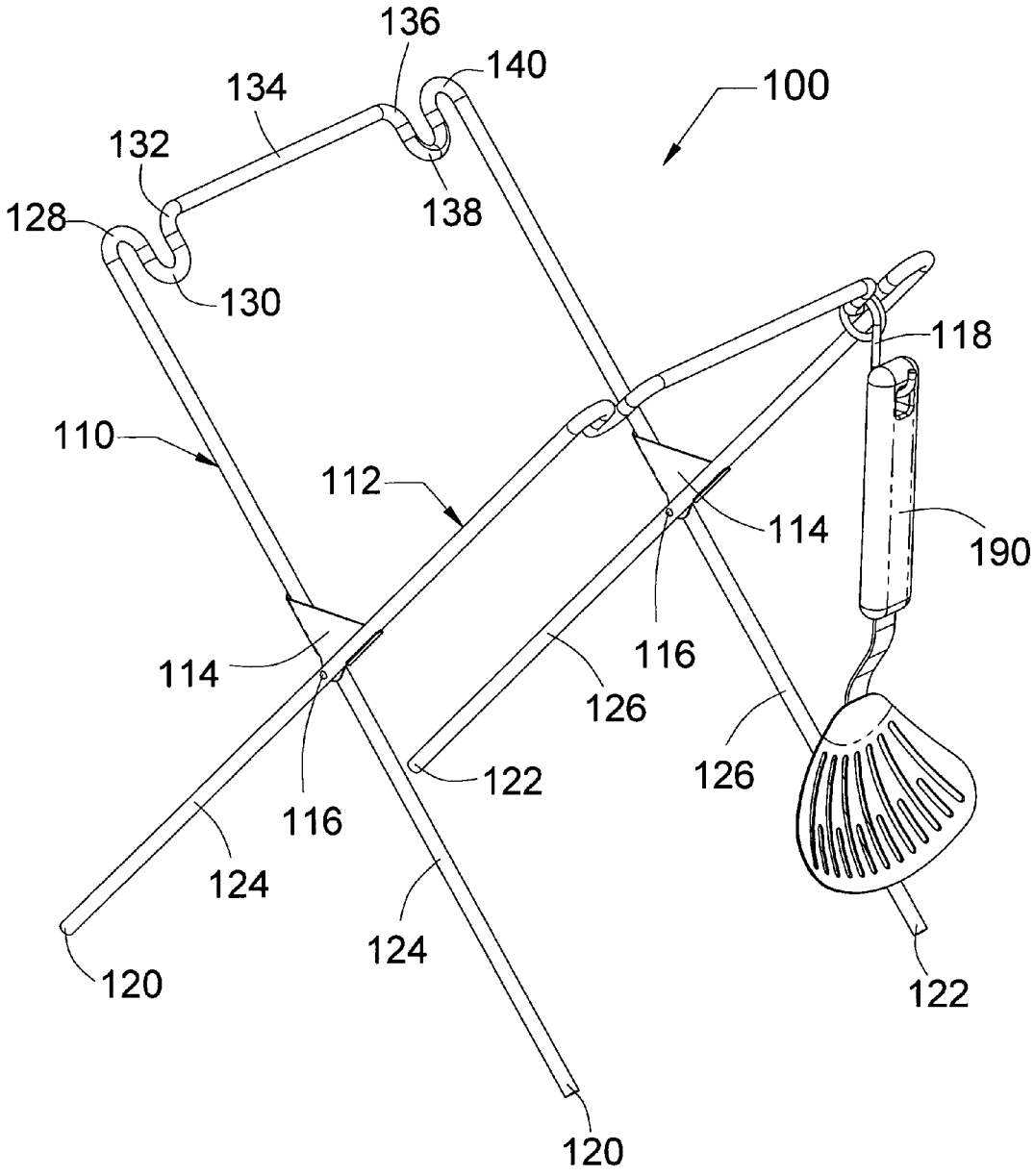
FIG. 1 is a perspective view of the first embodiment in the open position.
Figure 3:
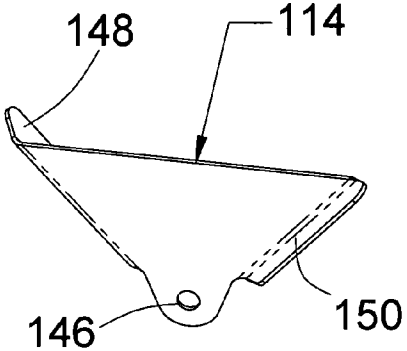
FIG. 3 is a perspective view of the angle stop.
Figure 2:
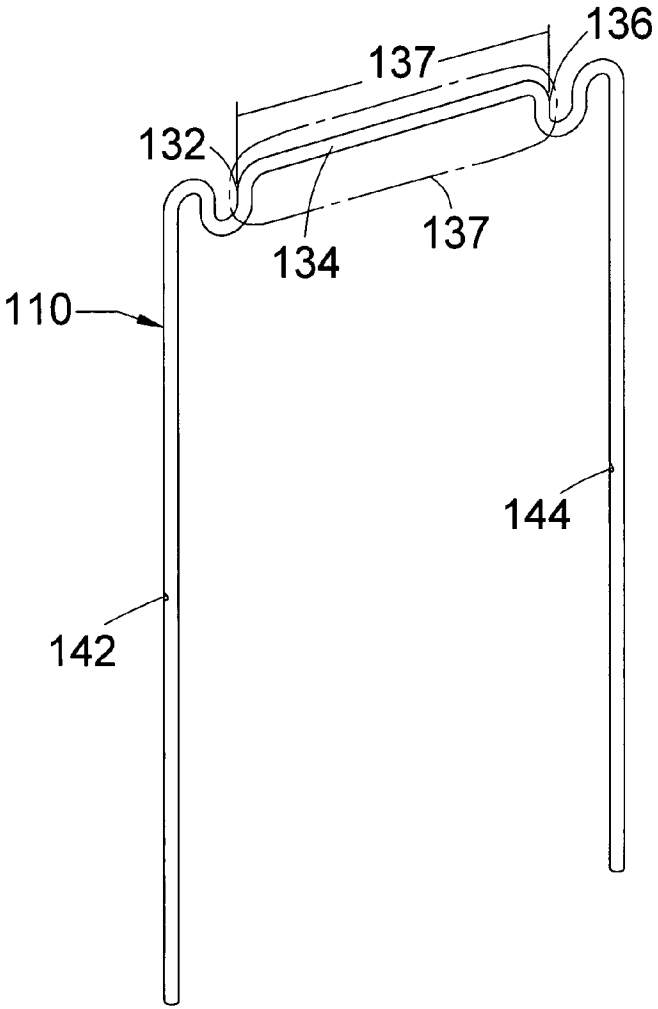
FIG. 2 is a perspective view of the first embodiment frame.
Figure 4:
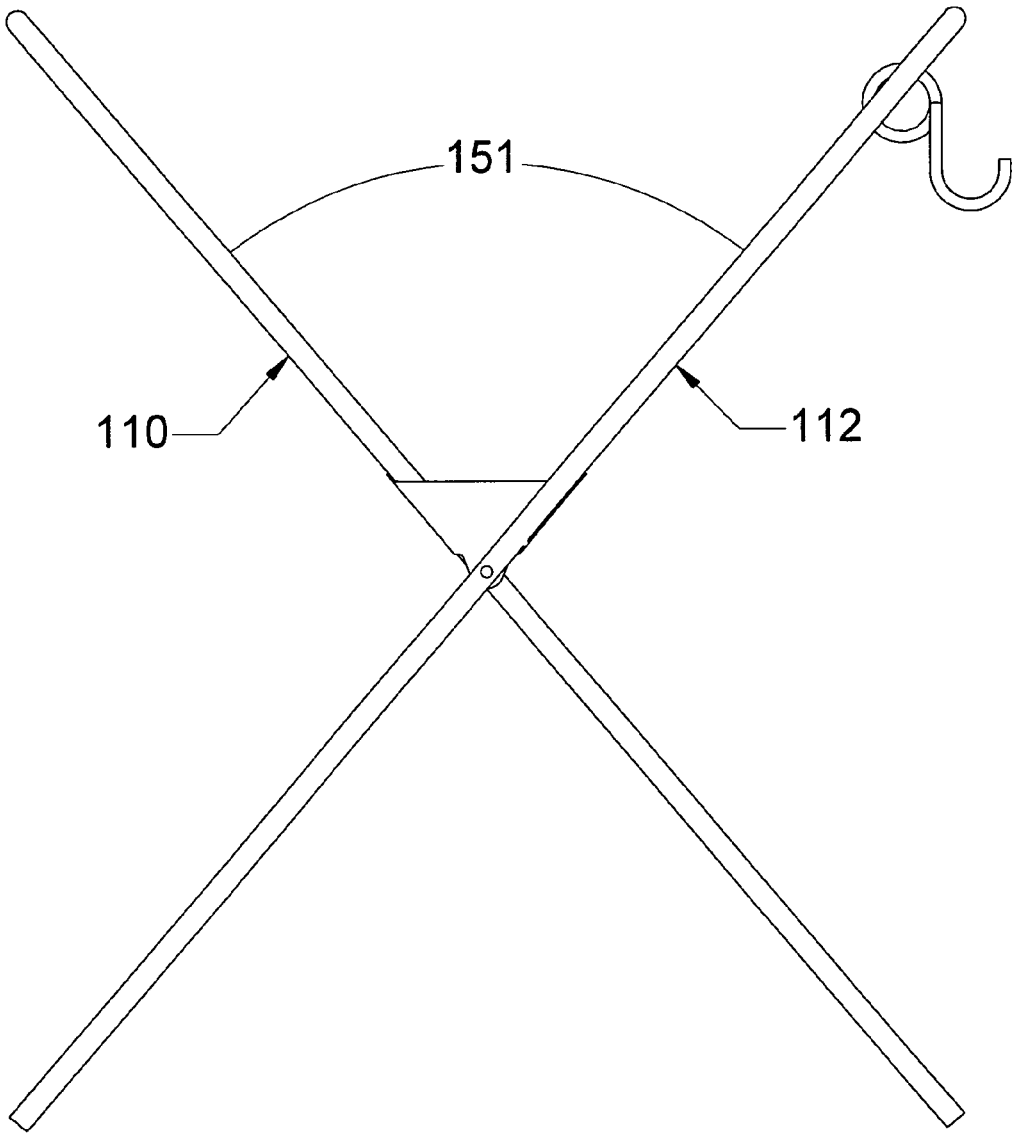
FIG. 4 is a side elevation view of the first embodiment in the open position.
Figure 5:
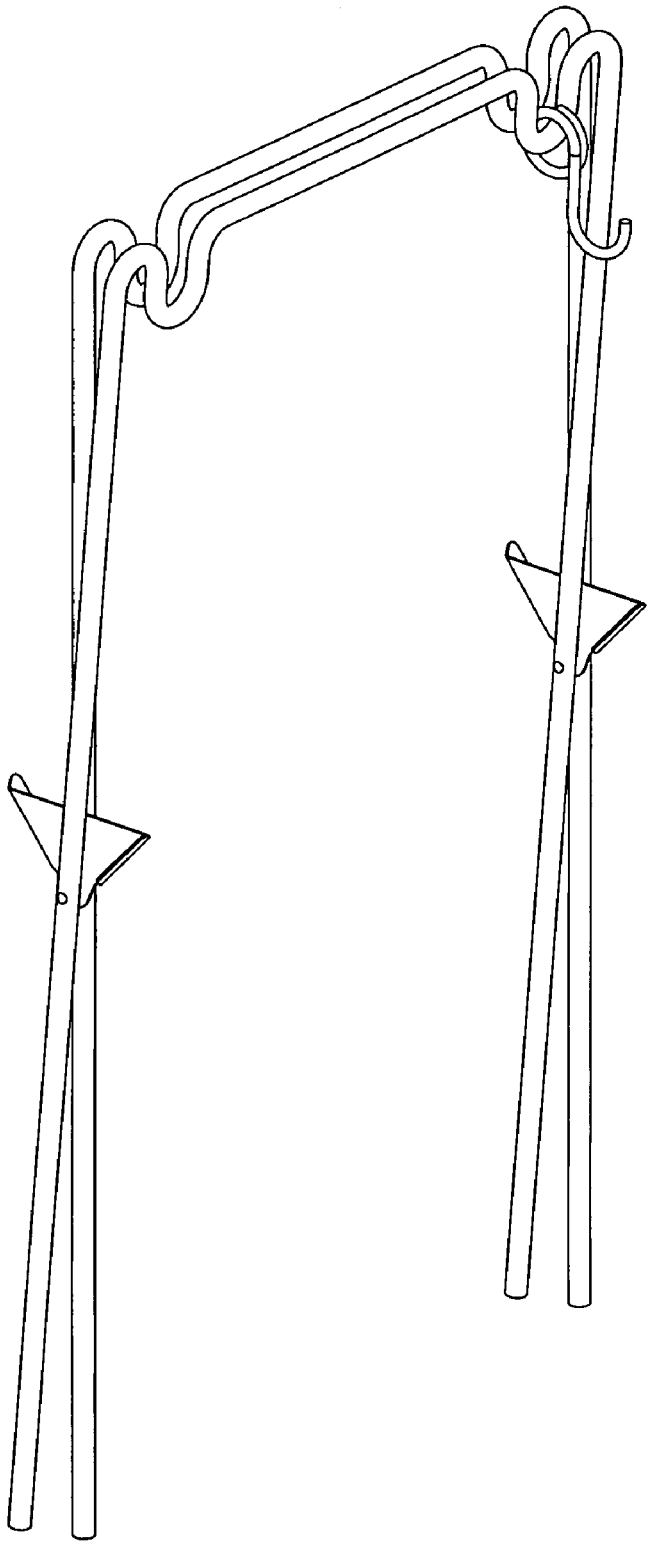
FIG. 5 is a perspective view of the first embodiment in the closed position.

Referring to FIGS. 1 and 2, the first embodiment 100 comprises a first frame 110, a second frame 112, two angle stops 114, two axles 116, and a hook 118. The first frame 110 and second frame 112 comprise a first foot 120, a second foot 122, a first leg 124, a first U-shaped bend 128, a second U-shaped bend 130, first L-shaped bend 132, an intermediate section 134, a second L-shaped bend 136, a third U-shaped bend 138, a fourth U-shaped bend 140, and a second leg 126. A handle loop section 137 is defined by the first L-shaped bend 132, the intermediate section 134, and the second L-shaped bend 136. The handle loop section 137 may be formed to have a length between 6.0 to 9.0 inches to accommodate bag handles of different sizes. First leg 124 and second leg 126 further comprise pivot holes 142 and 144. The first leg 124 and second leg 126 may be formed to have a length between 14 to 18 inches to accommodate bags of different sizes. The length is defined as the distance between the foot 120 and the top of the first U-shaped bend 128. The hook 118 may be used to hold items like a scoop 190, or bags (not shown), or other items (not shown). The hook rests in the second U-shaped bend 130 or the third U-shaped bend 138 of the first frame 110 or second frame 112. The first frame 110 and second frame 112 may be formed from bending round wire, square or polygon shaped metal stock, round or polygon shaped tubing, injection molded plastic, die cast metal, or any equivalents thereof.

Referring to FIGS. 1-5, the angle stop 114 comprises a pivot hole 146, a first stop surface 148 and a second stop surface 150. The angle stop 114 may be formed of sheet metal, forged metal, injection molded plastic, die cast metal, or any equivalents thereof. The angle stop 114 is disposed between the first leg 124 of the first frame 110 and the first leg 124 of the second frame 112. The axle 116 is disposed in the pivot hole 142 of the first leg 124 of the first frame 110, the pivot hole 146 of angle stop 114, and the pivot hole 142 of the first leg 124 of the second frame 112. The axle 116 may be a bolt, a screw, a rivet, a pin, or any equivalents thereof. The first frame 110 and the second frame 112 rotate open and closed relative to each other about the pivot hole 142 and the axle 116. In the open position, FIG. 1, the first leg 124 of the first frame 110 rests against the first stop surface 148 and the first leg 124 of the second frame 112 rests against the second stop surface 150. Referring again to FIG. 4, the first frame 110 and the second frame 112 open to form the shape of the letter X in side elevation view. The angle 151 between the first frame 110 and the second frame 112 may be between 60 to 110 degrees when open to accommodate bags of different sizes. Referring again to FIG. 5, the first embodiment is shown in the closed or collapsed position.

Figure 6:
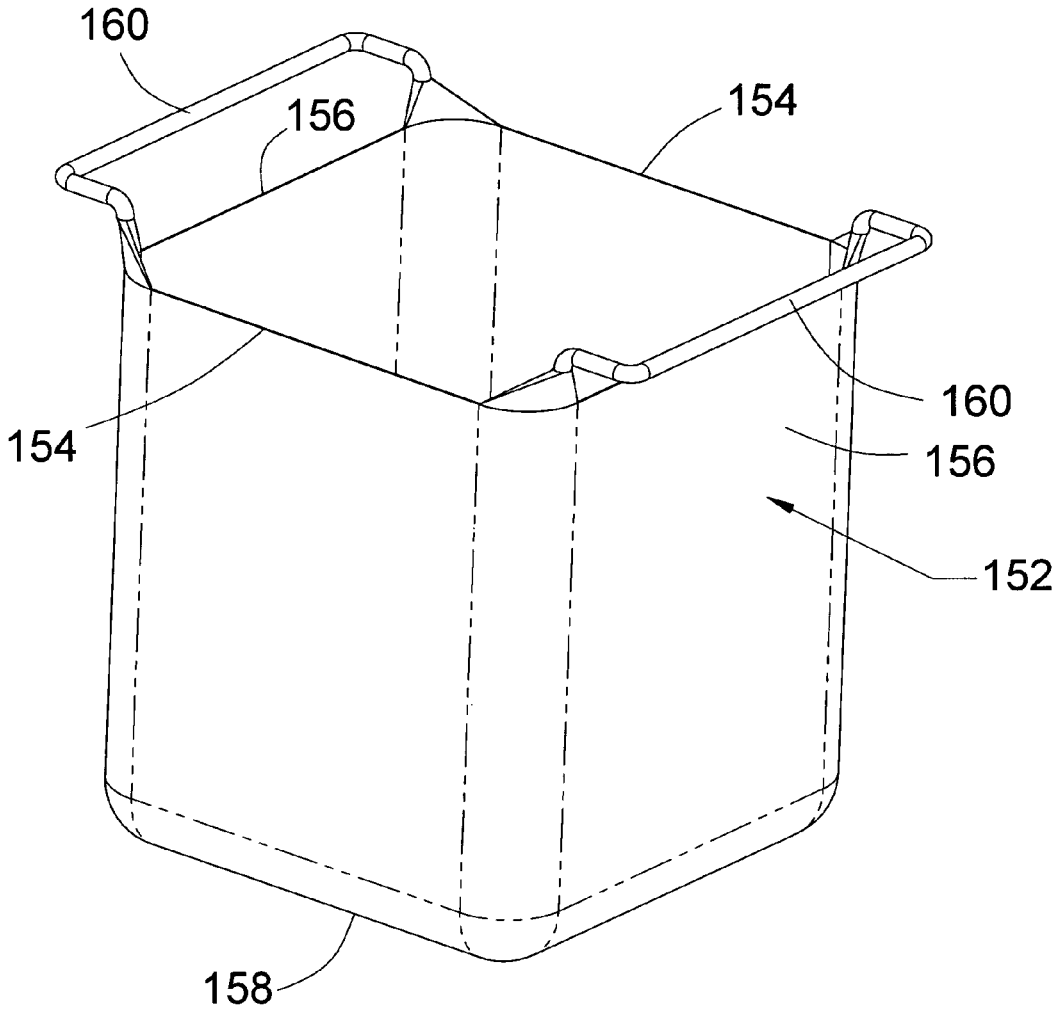
FIG. 6 is a perspective view of an open bag with integrally formed handles.
Figure 7:
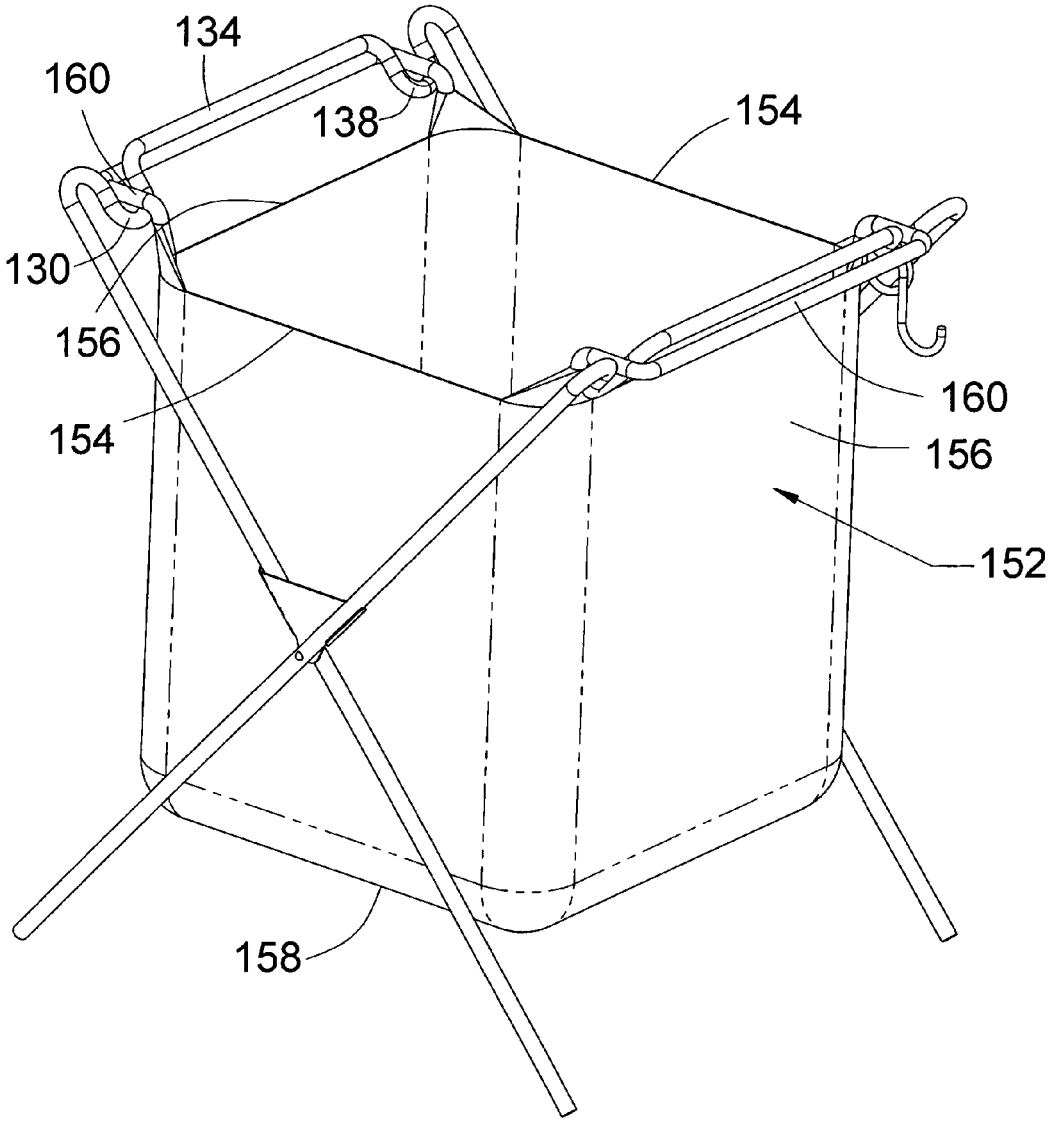
FIG. 7 is a perspective view of the first embodiment with a bag.
Figure 9:
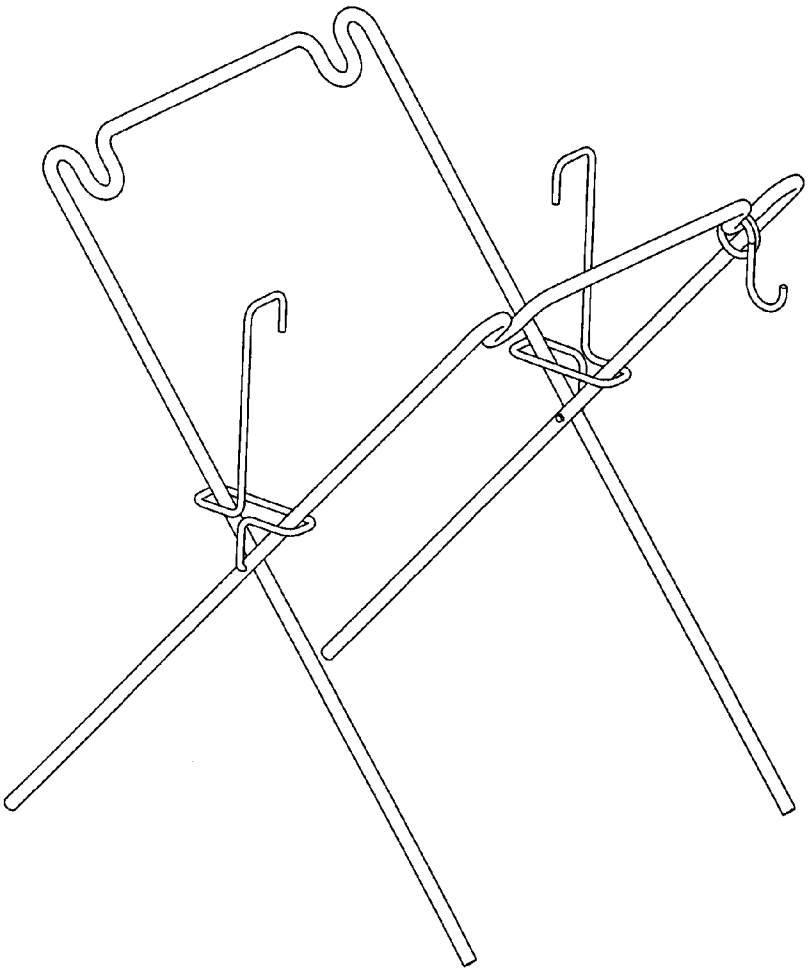
FIG. 9 is a perspective view of the first embodiment with the wire angle stop.
Figure 8:
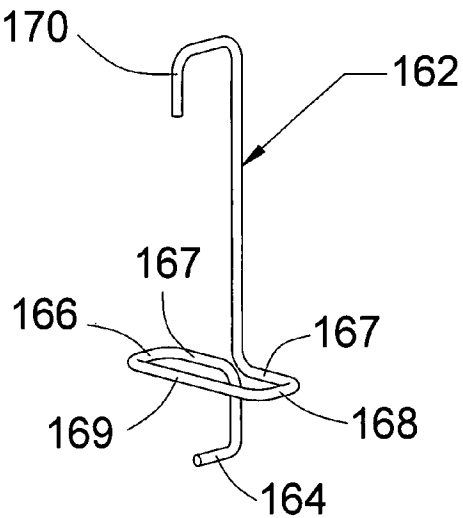
FIG. 8 is a perspective view of the wire angle stop.
Figure 10:
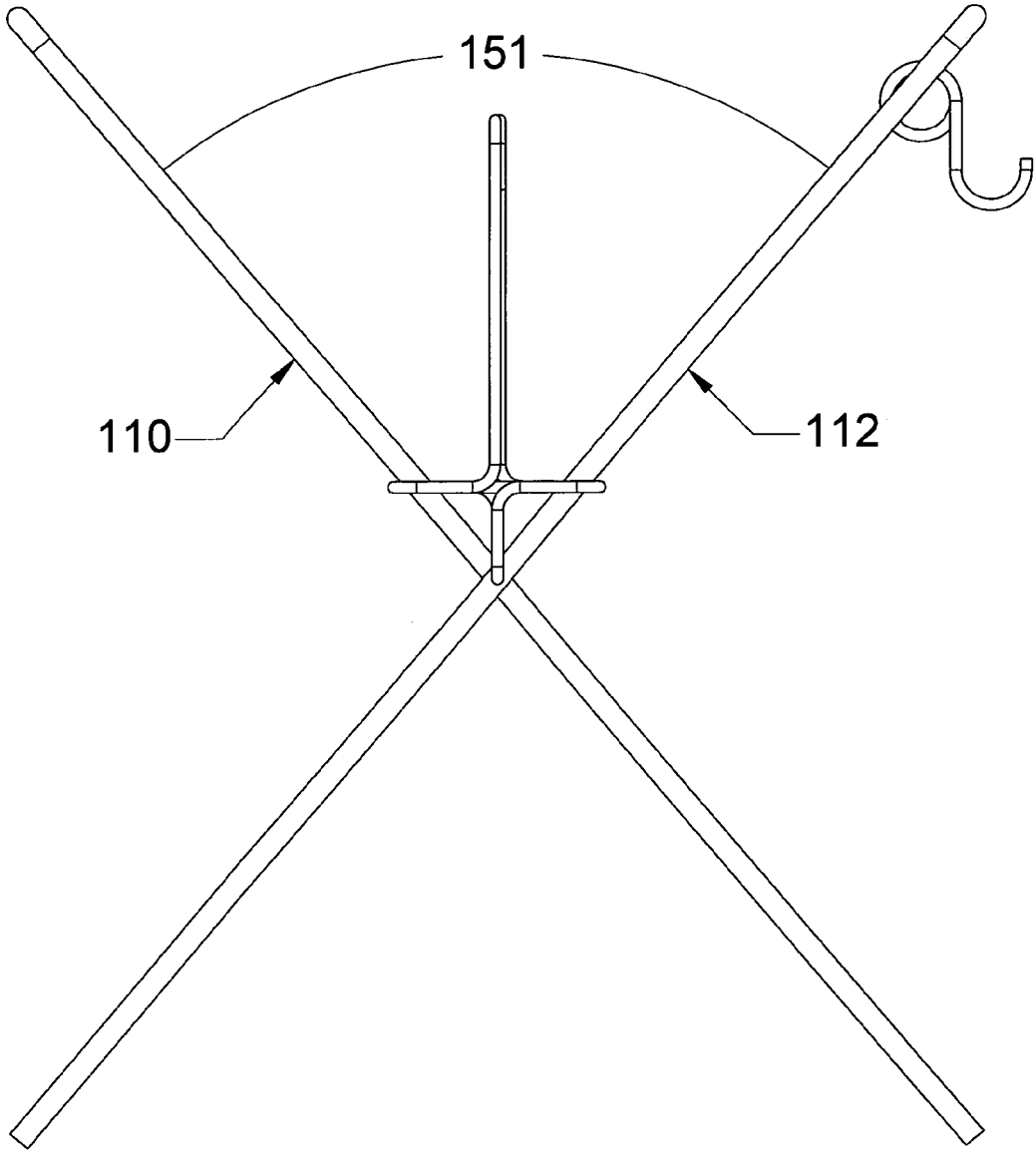
FIG. 10 is a side elevation view of the first embodiment with the wire angle stop in the open position.
Figure 11:
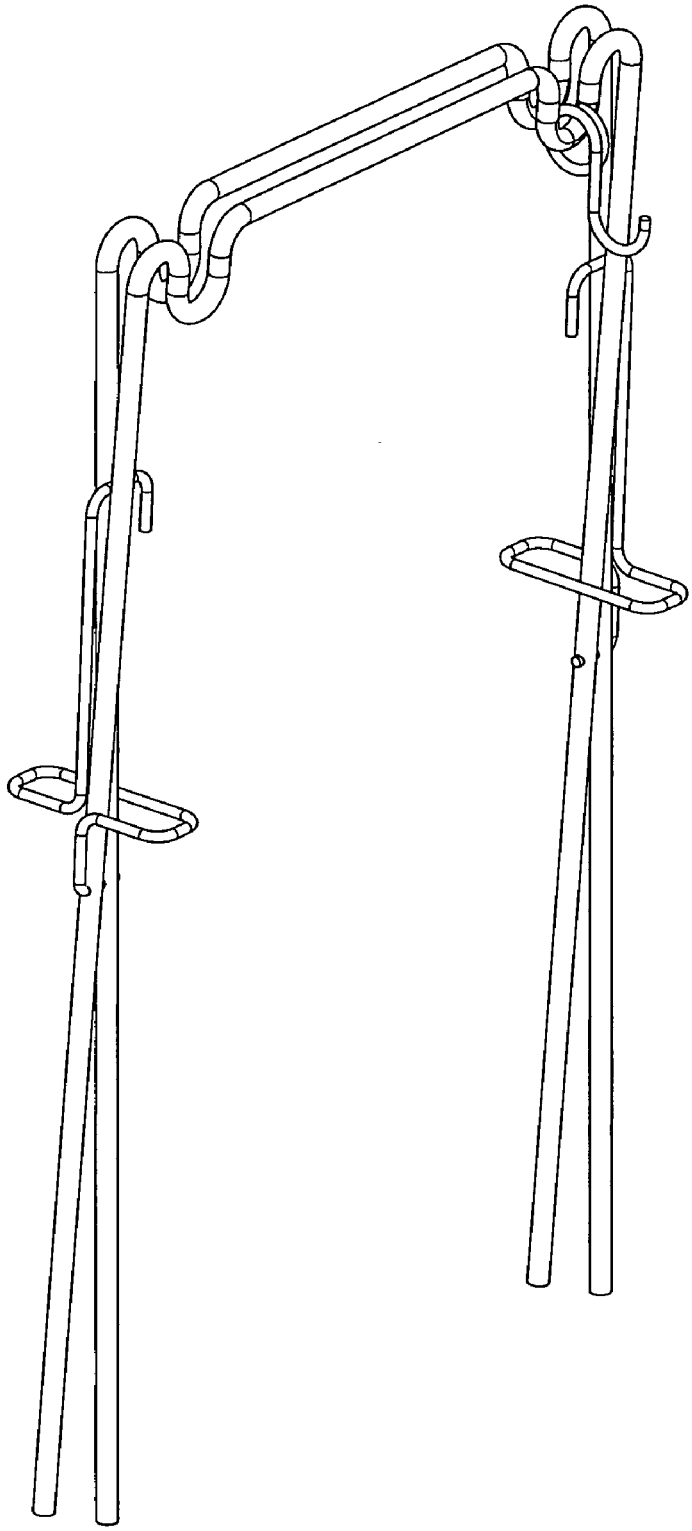
FIG. 11 is a perspective view of the first embodiment with the wire angle stop in the closed position.
Figure 12:
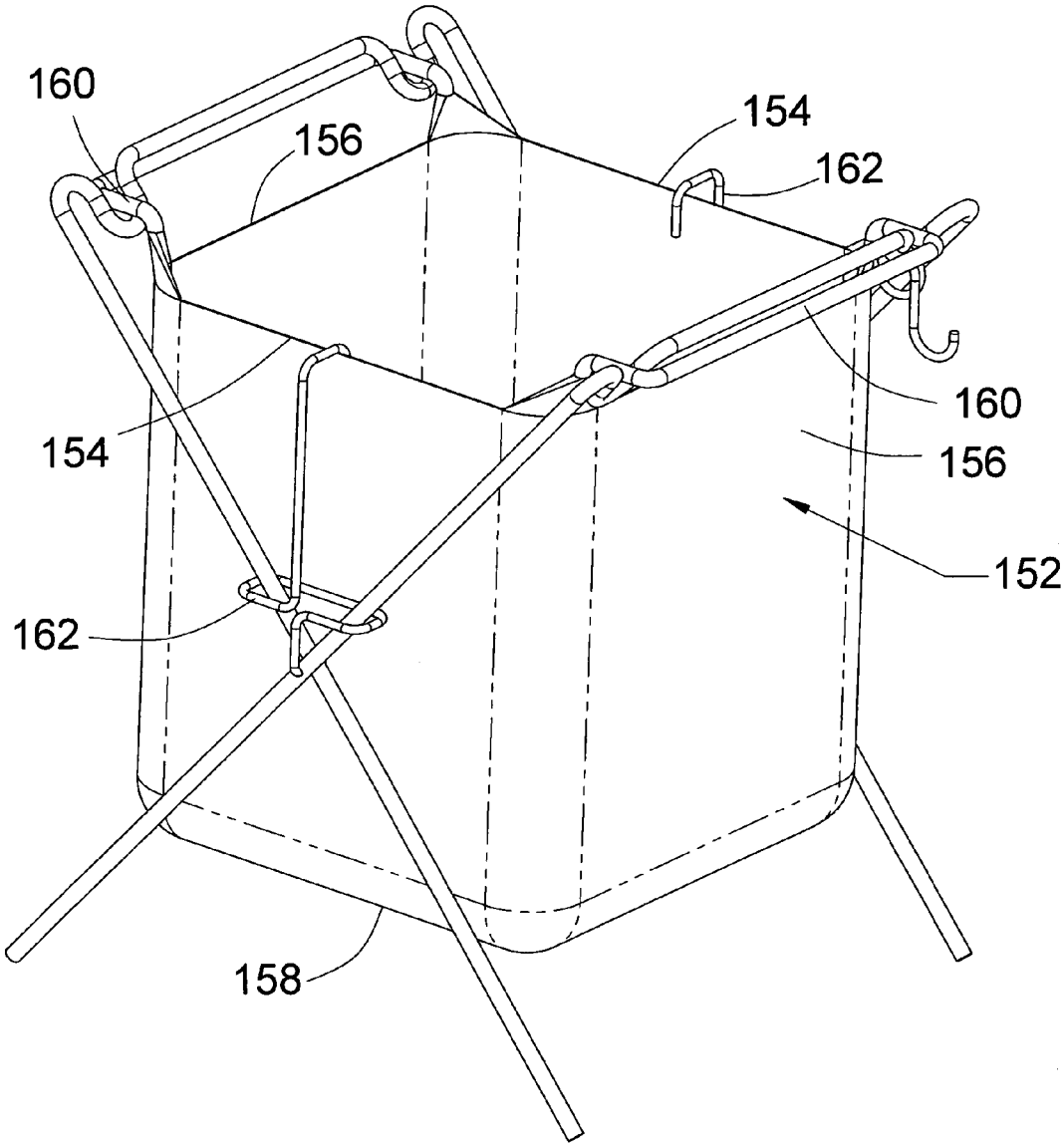
FIG. 12 is a perspective view of the first embodiment with the wire angle stop and a bag.
Figure 13:
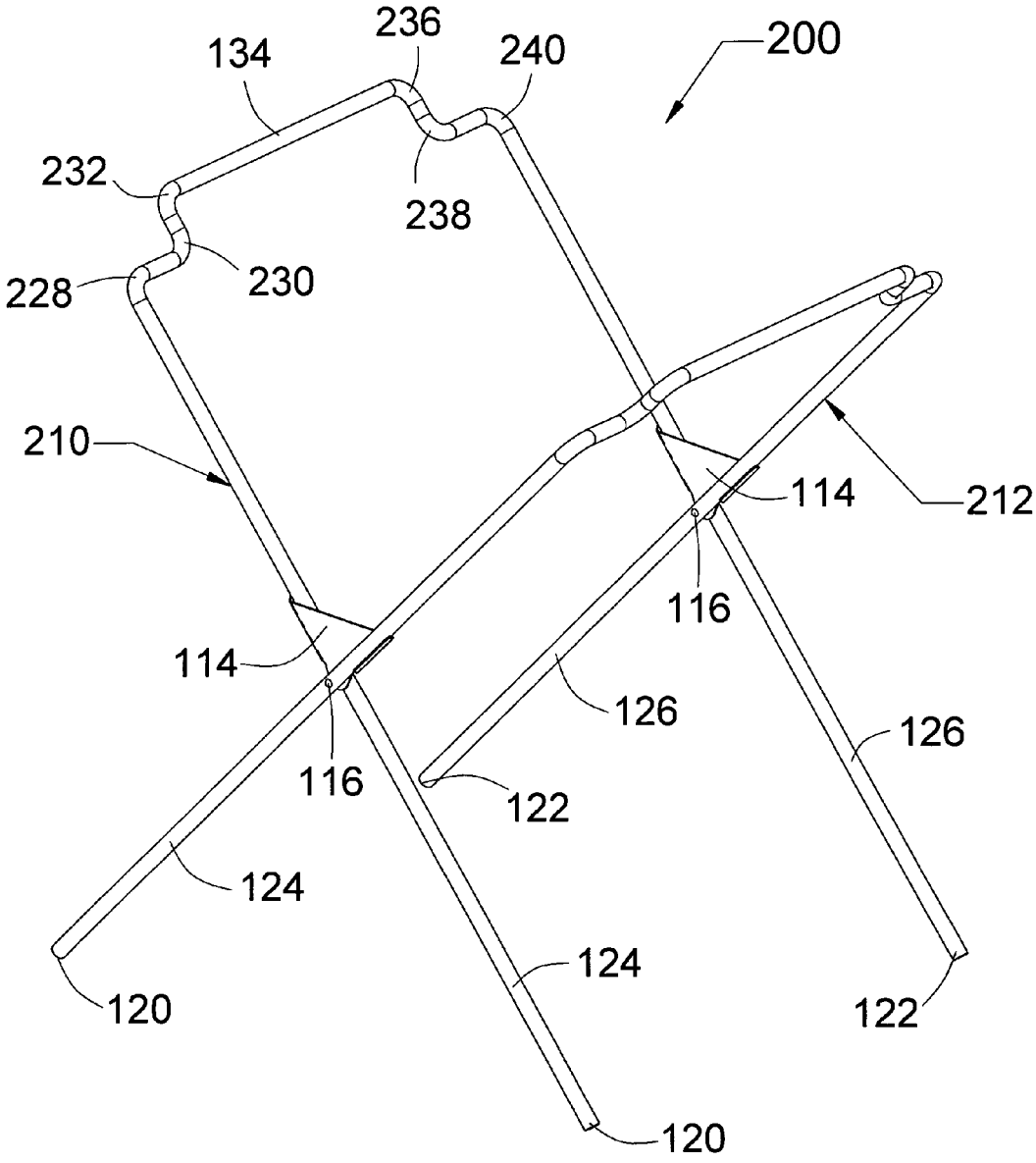
FIG. 13 is a perspective view of the second embodiment in the open position.
Figure 14:
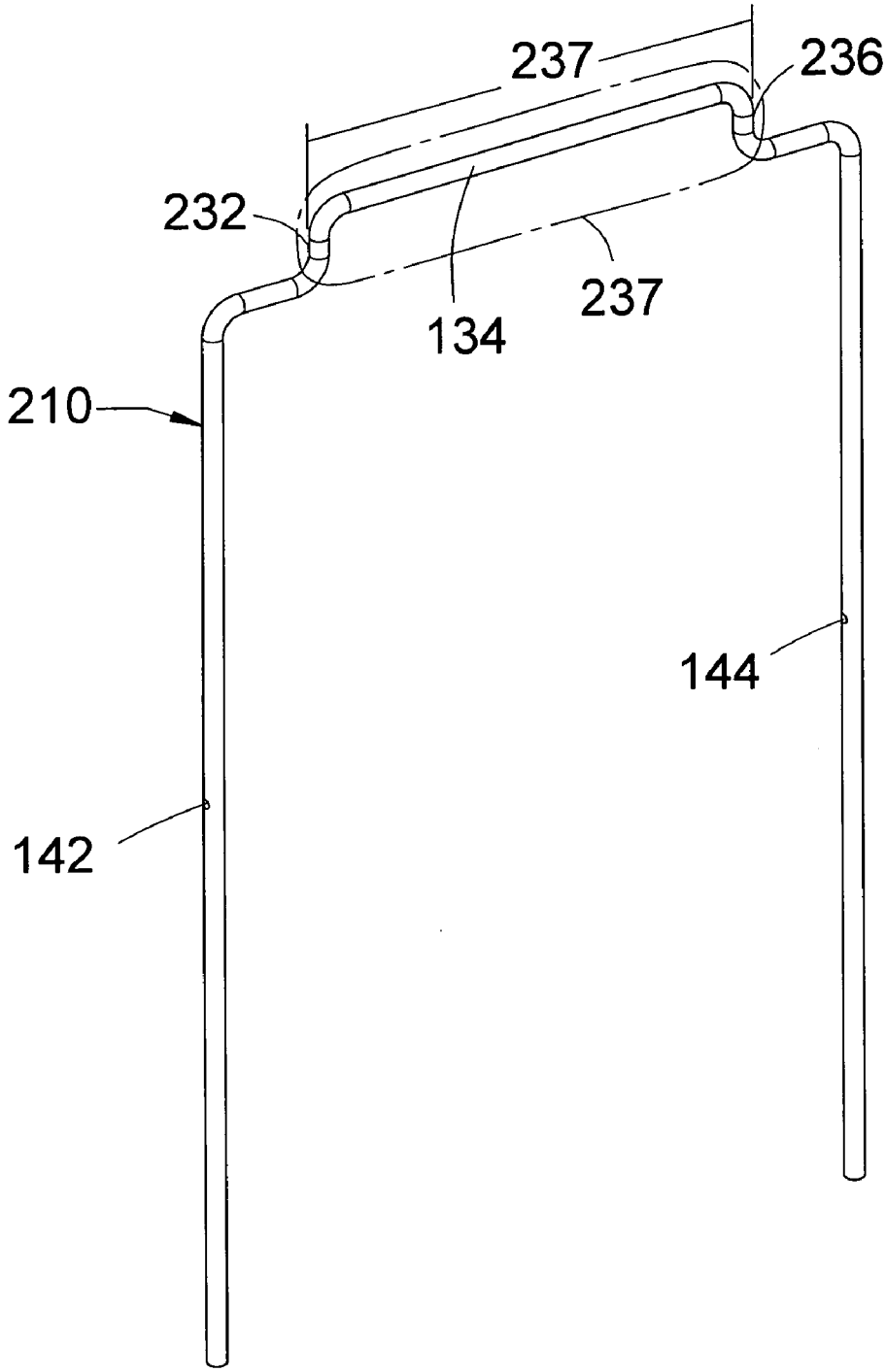
FIG. 14 is a perspective view of the second embodiment frame.
Figure 15:
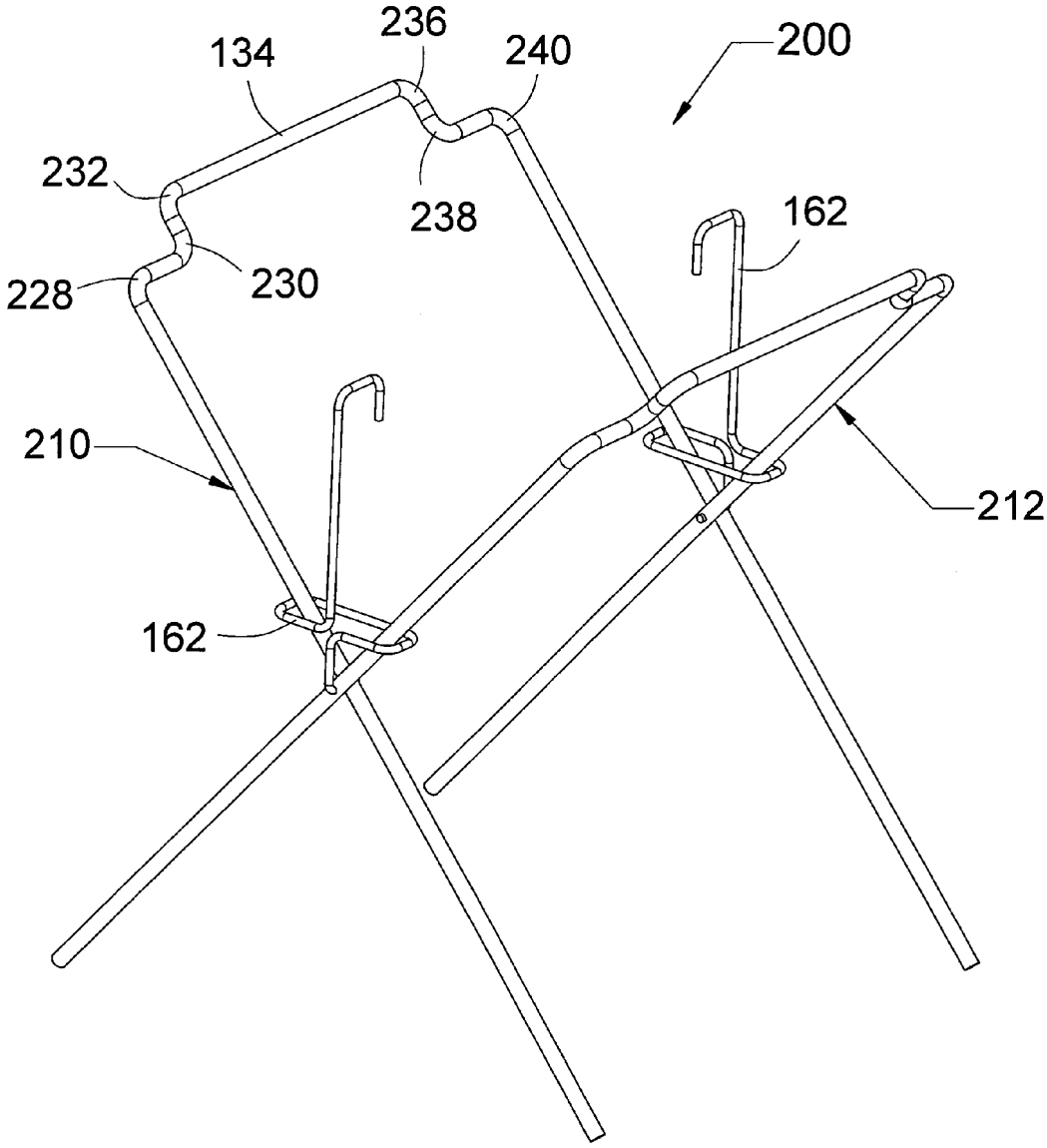
FIG. 15 is a perspective view of the second embodiment with the wire angle stop.
Figure 16:
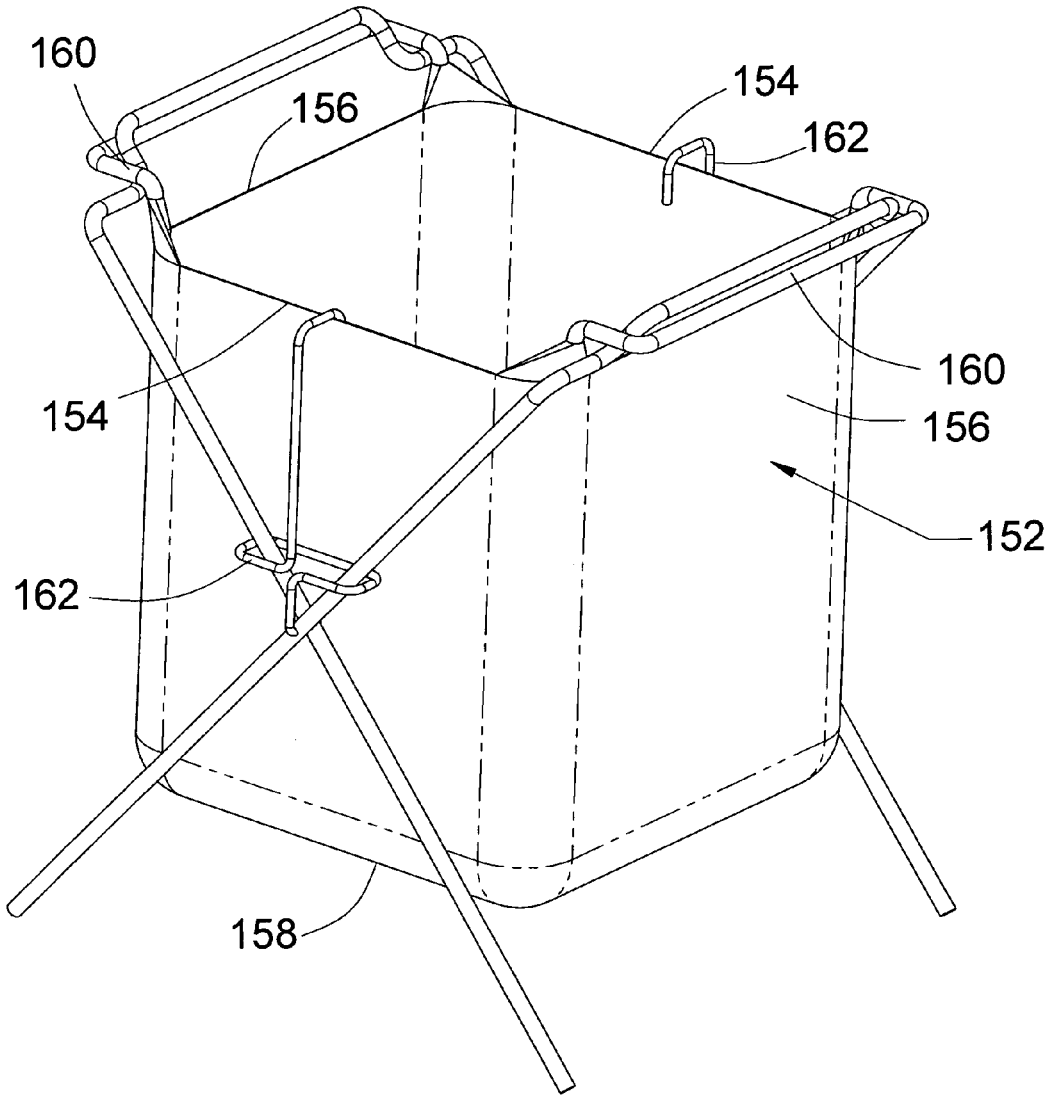
FIG. 16 is a perspective view of the second embodiment with the wire angle stop and a bag.

Referring to FIGS. 6 and 7, a bag 152, comprises two bag sides 154, two bag ends 156, a bag bottom 158, and two integrally formed bag handles 160. The bag 152 is held by the first embodiment 100, by placing one bag handle 160 around the intermediate section 134, and into the second U-shaped bend 130 and the third U-shaped bend 138. The second U-shaped bend 130 and the third U-shaped bend 138 are designed to help the user guide the bag handle 160 around the intermediate section 134. Referring again to FIG. 4, the angle stop 114 allows the first frame 110 and the second frame 112 open to form the shape of the letter X, whereby the intermediate section 134, the second U-shaped bend 130 and the third U-shaped bend 138 of first frame 110 and second frame 112 are sufficiently spaced apart to hold a bag 152 open. Additionally, the intermediate section 134, the second U-shaped bend 130 and the third U-shaped bend 138 of first frame 110 and second frame 112 are sufficiently spaced above first foot 120 and second foot 122 to sufficiently hold the bag 152 upright.

Referring to FIGS. 8-12, a wire angle stop 162 comprises an integral axle 164, a first stop surface 166, a second stop surface 168, a first side surface 167, a second side surface 169, and an upper hook 170. The integral axle 164 is disposed in the pivot hole 142 of the first leg 124 of the first frame 110 and in the pivot hole 142 of the first leg 124 of the second frame 112. The first leg 124 of the first frame 110 and the first leg 124 of the second frame 112 are disposed between the first stop surface 166, the second stop surface 168, the first side surface 167, and the second side surface 169 of the wire angle stop 162. The first frame 110 and the second frame 112 rotate open and closed relative to each other about the pivot hole 142 and the integral axle 164. In the open position, FIG. 9, the first leg 124 of the first frame 110 rests against the first stop surface 166 and the first leg 124 of the second frame 112 rests against the second stop surface 168. The upper hook 170 holds the bag sides 154 open when the bag 152 is installed in the first embodiment 100. The wire angle stop 162 may be formed from bending round wire, square or polygon shaped metal stock, round or polygon shaped tubing, injection molded plastic, die cast metal, or any equivalents thereof.

Referring again to FIG. 10, the first frame 110 and the second frame 112 open to form the shape of the letter X in side elevation view. The angle 151 between the first frame 110 and the second frame 112 may be between 60 to 110 degrees when open to accommodate bags of different sizes. Referring again to FIG. 11, the first embodiment with the wire angle stop 162 is shown in the closed or collapsed position.

Referring to FIGS. 13-16, the second embodiment 200 comprises a first frame 210, a second frame 212, two angle stops 114, and two axles 116. The first frame 210 and second frame 212 comprise a first foot 120, a second foot 122, a first leg 124, a first L-shaped bend 228, a second L-shaped bend 230, third L-shaped bend 232, an intermediate section 134, a fourth L-shaped bend 236, a fifth L-shaped bend 238, a sixth L-shaped bend 240, and a second leg 126. A handle loop section 237 is defined by the third L-shaped bend 232, the intermediate section 134, and the fourth L-shaped bend 236. The handle loop section 237 may be formed to have a length between 6.0 to 9.0 inches to accommodate bag handles of different sizes. First leg 124 and second leg 126 further comprise pivot holes 142 and 144. The angle stop 114 is disposed between the first leg 124 of the first frame 210 and the first leg 124 of the second frame 212. The axle 116 is disposed in the pivot hole 142 of the first leg 124 of the first frame 210, the pivot hole 146 of the angle stop 114, and the pivot hole 142 of the first leg 124 of the second frame 212. The first frame 210 and the second frame 212 rotate open and closed relative to each other about the pivot hole 142 and the axle 116. The first leg 124 and second leg 126 may be formed to have a length between 14 to 18 inches to accommodate bags of different sizes. The length is defined as the distance between the foot 120 and the top of the first L-shaped bend 228. The second embodiment 200 may substitute each angle stop 114 and axle 116 with the wire angle stop 162. The integral axle 164 is disposed in the pivot hole 142 of the first leg 124 of the first frame 210 and in the pivot hole 142 of the first leg 124 of the second frame 212. The first leg 124 of the first frame 210 and the first leg 124 of the second frame 212 are disposed between the first stop surface 166, the second stop surface 168, the first side surface 167, and the second side surface 169 of the wire angle stop 162. The first frame 210 and the second frame 212 rotate open and closed relative to each other about the pivot hole 142 and the integral axle 164. In the open position, FIG. 15, the first leg 124 of the first frame 210 rests against the first stop surface 166 and the first leg 124 of the second frame 212 rests against the second stop surface 168. The first frame 210 and second frame 212 may be formed from bending round wire, square or polygon shaped metal stock, round or polygon shaped tubing, injection molded plastic, die cast metal, or any equivalents thereof. The bag 152 is held by the second embodiment 200 in a similar fashion as the first embodiment 100, by placing one bag handle 160 around the third L-shaped bend 232, the intermediate section 134, and the fourth L-shaped bend 236.

The description of the aforementioned embodiments is in no way intended to be restricted to the description and drawings used to explain the several embodiments. It is recognized that modifications may be made, by one of ordinary skill in the art, without departing from the intent of the embodiments. The scope of the embodiments are to be taken as described herein as well as including all reasonable equivalents of the subject matter described herein above.

FIGURE LIST first embodiment 100
first frame 110
second frame 112
angle stop 114
axle 116
a hook 118
first foot 120
second foot 122
first leg 124
second leg 126
first U-shaped bend 128
second U-shaped bend 130
first L-shaped bend 132
intermediate section 134
second L-shaped bend 136
handle loop section 137
third U-shaped bend 138
fourth U-shaped bend 140
pivot hole 142
pivot hole 144
pivot hole 146
first stop surface 148
second stop surface 150
bag 152
bag side 154
bag end 156
bag bottom 158
bag handle 160
wire angle stop 162
integral axle 164
first stop surface 166
first side surface 167
second stop surface 168
second side surface 169
upper hook 170
scoop 190
second embodiment 200
first frame 210
second frame 212
first L-shaped bend 228
second L-shaped bend 230
third L-shaped bend 232
fourth L-shaped bend 236
handle loop section 137
fifth L-shaped bend 238
sixth L-shaped bend 240

I claim:

1. A collapsible bag holder, comprising:

a. a first frame, a second frame, a first angle stop, and a second angle stop;

b. wherein said first frame and said second frame comprise a first leg, a first U-shaped bend, a second U-shaped bend, a first L-shaped bend, an intermediate section, a second L-shaped bend, a third U-shaped bend, a fourth U-shaped bend, and a second leg;

c. wherein said first leg and said second leg further comprise a pivot hole;

d. wherein said first angle stop and said second angle stop comprise an integrated axle, a first stop surface, a second stop surface, a first side surface and a second side surface;

e. wherein said integrated axle is disposed inside said pivot hole of said first leg of said first frame and inside said pivot hole of said first leg of said second frame;

f. wherein said first leg of said first frame and said first leg of said second frame are disposed between said first stop surface, said second stop surface, said first side surface, and said second side surface.

2. The collapsible bag holder of claim 1, further comprising a hook wherein said hook is disposed in said second U-shaped bend of said first frame.

3. The collapsible bag holder of claim 1, wherein said first angle stop and said second angle stop further comprise an upper hook.

4. The collapsible bag holder of claim 1, wherein the distance between said first L-shaped bend and said second L-shaped bend is between 6.0 to 9.0 inches.

5. The collapsible bag holder of claim 4, wherein said first leg and said second leg of said first frame and said second frame have a length between 14 to 18 inches.

6. The collapsible bag holder of claim 5, wherein said first frame and said second frame are open to an angle between 60 to 110 degrees.

7. The collapsible bag holder of claim 1, wherein said first leg and said second leg of said first frame and said second frame have a length between 14 to 18 inches.

8. The collapsible bag holder of claim 1, wherein said first frame and said second frame are open to an angle between 60 to 110 degrees.

9. A collapsible bag holder, comprising:

a. a first frame, a second frame, a first angle stop, and a second angle stop;

b. wherein said first frame and said second frame comprise a first leg, a first L-shaped bend, a second L-shaped bend, a third L-shaped bend, an intermediate section, a fourth L-shaped bend, a fifth L-shaped bend, a sixth L-shaped bend, and a second leg;

c. wherein said first leg and said second leg further comprise a pivot hole;

d. wherein said first angle stop and said second angle stop comprise an integrated axle, a first stop surface, a second stop surface, a first side surface and a second side surface;

e. wherein said integrated axle is disposed inside said pivot hole of said first leg of said first frame and inside said pivot hole of said first leg of said second frame;

f. wherein said first leg of said first frame and said first leg of said second frame are disposed between said first stop surface, said second stop surface, said first side surface, and said second side surface.

10. The collapsible bag holder of claim 9, wherein the distance between said third L-shaped bend and said fourth L-shaped bend is between 6.0 to 9.0 inches.

11. The collapsible bag holder of claim 10, wherein said first leg and said second leg of said first frame and said second frame have a length between 14 to 18 inches.

12. The collapsible bag holder of claim 11, wherein said first frame and said second frame are open to an angle between 60 to 110 degrees.

13. The collapsible bag holder of claim 9, wherein said first leg and said second leg of said first frame and said second frame have a length between 14 to 18 inches.

14. The collapsible bag holder of claim 9, wherein said first frame and said second frame are open to an angle between 60 to 110 degrees.

* * * * *